US007040395B2

(12) United States Patent
Booth

(10) Patent No.: US 7,040,395 B2
(45) Date of Patent: May 9, 2006

(54) APPARATUS AND METHOD FOR DEBRIS IN A WELL BORE

(75) Inventor: Richard Keith Booth, Isle of Man (GB)

(73) Assignee: Hamdeen Incorporated Limited, Isle of Man (GB)

( * ) Notice: Subject to any disclaimer, the term of this patent is extended or adjusted under 35 U.S.C. 154(b) by 243 days.

(21) Appl. No.: 10/473,947

(22) PCT Filed: Apr. 5, 2002

(86) PCT No.: PCT/GB02/01494

§ 371 (c)(1),
(2), (4) Date: Oct. 2, 2003

(87) PCT Pub. No.: WO02/081858

PCT Pub. Date: Oct. 17, 2002

(65) Prior Publication Data

US 2004/0094302 A1 May 20, 2004

(30) Foreign Application Priority Data

Apr. 5, 2001 (GB) ..... 0108539

(51) Int. Cl.
*E21B 37/02* (2006.01)

(52) U.S. Cl. ..... 166/173; 166/169; 166/334.4

(58) Field of Classification Search ..... 166/169, 166/170, 173, 177.3, 334.4
See application file for complete search history.

(56) References Cited

U.S. PATENT DOCUMENTS

| | | | | |
|---|---|---|---|---|
| 3,123,157 | A | 3/1964 | Graham | |
| 5,330,003 | A | 7/1994 | Bullick | |
| 6,607,031 | B1 * | 8/2003 | Lynde et al. | 166/99 |
| 6,695,058 | B1 * | 2/2004 | French | 166/312 |

* cited by examiner

*Primary Examiner*—Zakiya W. Bates
(74) *Attorney, Agent, or Firm*—Drinker Biddle & Reath LLP

(57) ABSTRACT

A downhole tool is provided for use within a casing. The tool includes a collector tool that has a cylindrical body having an external diameter smaller than the casing diameter so as to form an annular gap between the body and the casing. A first downhole fluid passage is provided in the body, which has an upper inlet and a lower outlet. At least one secondary fluid passage extends between the first downhole fluid passage and the annular gap, with a filter arranged between the at least one secondary fluid passage and outlet. A first sleeve member is provided on the body and adapted to move between a first position in which the at least one secondary fluid passage is closed, and a second position in which the at least one secondary fluid passage is open.

34 Claims, 5 Drawing Sheets

APPARATUS AND METHOD FOR DEBRIS IN A WELL BORE

The present invention relates to a downhole tool for collecting debris in a well bore, and in particular to a downhole tool which can be inserted into a well bore and can carry out cleaning of the well bore casing and debris collecting with the minimum of surface intervention.

It is known in oil and gas production to provide tools known as scrapers to clean the inside of a casing in a well. During the cementing process, cement slurry is first pumped down the internal bore of the casing and then displaced using another fluid, typically mud, from the lower end of the casing and up into the annular space between the casing and the rock formation. Nearer the surface, the annular spacing will be between the casing and a larger casing that was previously cemented in place. Some of the cement slurry will adhere to the internal wall of the casing.

Scrapers can be used to remove the cement from the inside surface of the casing. Typically the particles of cement and other debris, such as metal or oxidation particles, scale, burrs and shavings, which arise from the scraping operation are removed by the circulation of well fluid such as drilling mud or brine through the well, and may be separated from the well fluid by filtration at the well surface. However some particles, because of their size or specific weight, are not readily transported by the mud or brine, and it has been proposed to use collecting tools to filter or screen well fluid in the well. Such a collecting tool is disclosed in GB 2335687A. However such collecting tools suffer from the disadvantage that they require ball valves, which are prone to clogging.

Known scraping tools suffer from the disadvantage that during extraction of the tool from the well hole further debris can be dislodged, so that debris remains in the well hole after the cleaning operation.

It is an object of the present invention to provide a collecting tool which is automatic in operation, which provides a filtering function when the tool is pulled out of a well hole, but which allows the filter to be bypassed when the tool is run into a well hole.

It is a further object of the invention to provide a scraper tool which avoids the dislodging of debris from the side of the casing when the scraper tool is pulled out of a well hole, and which provides an even, self-cleaning, scraping action in use.

According to a first aspect of the invention there is provided a downhole collector tool for use within a casing, comprising:

- a cylindrical body having an external diameter smaller than the casing diameter so as to form an annular gap between the body and the casing;
- a first downhole fluid passage provided in the body and having an upper inlet and a lower outlet;
- at least one secondary fluid passage extending between the first downhole fluid passage and the annular gap;
- a filter means arranged between said at least one secondary fluid passage and said outlet; and
- a first sleeve member provided on the body and adapted to move between a first position in which said at least one secondary fluid passage is closed and a second position in which said at least one secondary fluid passage is open.

Preferably the first sleeve member is provided with friction means adapted to engage with the interior surface of the casing. Preferably the friction means comprises one or more pads, most preferably four pads, provided on the exterior of the sleeve. Preferably the or each pad is urged towards the casing by biasing means. Preferably the biasing means comprises one or more disc springs.

Preferably the first sleeve member is arranged such that movement of the tool downwardly relative to the casing urges the first sleeve member to the first position. Preferably the first sleeve member is arranged such that movement of the tool upwardly relative to the casing urges the first sleeve member to the second position.

There may be a plurality of secondary fluid passages. In a preferred embodiment the tool comprises four secondary fluid passages arranged substantially radially. The first sleeve member may comprise seal means to ensure that the passages are sealedly closed when the first sleeve member is in the first position.

Preferably the first sleeve member is provided with apertures or cut-out portions adapted to permit fluid flow in the annulus past the first sleeve member.

Preferably the filter means is a screen, most preferably a cylindrical slotted screen extending along the first downhole fluid passage. Preferably the screen extends from a location distant from the opening of the secondary fluid passage. Preferably the screen extends from a location at least 250 mm from the opening of the secondary fluid passage.

Preferably the apertures of the screen have a diameter of less than 1.5 mm.

Preferably the tool also includes at least one bypass return fluid passage adapted to permit upward fluid flow though the annular gap when said at least one secondary fluid passage is closed. Preferably the tool also includes a bypass valve for opening and closing said bypass return fluid passage. There may be a number of axially extending bypass fluid return passages arranged around the circumference of the cylindrical body. The bypass return fluid passage may be formed as a channel in the exterior surface of the cylindrical body.

Preferably the bypass valve comprises a second sleeve member provided on the body. Preferably the second sleeve member is provided with friction means adapted to engage with the interior surface of the casing. Preferably the friction means comprises a seal extending around the second sleeve member. Preferably the seal is adapted to prevent fluid flow between the second sleeve member and the casing. Preferably the seal is urged towards the casing by biasing means.

Preferably the second sleeve member is arranged such that movement of the tool upwardly relative to the casing urges the second sleeve member to a first position in which the bypass return flow passage is closed. Preferably the second sleeve member is arranged such that movement of the tool downwardly relative to the casing urges the second sleeve member to a second position in which the bypass return flow passage is open. Preferably the second sleeve member is arranged such that fluid flowing in the annulus also urges the second sleeve member to the first position.

Preferably the first and second sleeve members are rotatably arranged on the cylindrical body. This allows the drill string to be rotated for drilling purposes without the sleeve members having to rotate relative to the casing.

Preferably the collector tool includes inhibiting means adapted to inhibit movement of the first sleeve member from the first position towards the second position.

Preferably the inhibiting means comprises a ball or roller bearing positioned within a recess provided on the first sleeve member, the bearing being spring urged towards the cylindrical body such that the first sleeve member must overcome the urging force to move to the second position. Alternatively the inhibiting means comprises a ball or roller bearing positioned within a recess provided on the cylindrical body, the bearing being spring urged towards the casing such that the first sleeve member must overcome the urging force to move to the second position. Preferably the inhibiting means further comprises a detent provided at the cylindrical body and adapted to engage with a socket provided on the first sleeve member when the first sleeve member is in the first position. The detent may be provided in a recess provided in the cylindrical body and spring urged towards the socket. Alternatively the detent may be provided in an aperture in fluid communication with at least one of the first fluid passage or the secondary fluid passage, the detent being urged towards the socket by fluid flowing in the or each passage.

Preferably at least one secondary fluid passage is provided proximal to the lower outlet. Preferably a third sleeve member is provided on the body and is adapted to move between a first position in which the or each lower secondary fluid passage is closed and a second position in which the or each lower secondary fluid passage is open.

According to a second aspect of the invention there is provided a downhole scraper tool for use within a casing, comprising:

- a cylindrical body having an external diameter smaller than the casing diameter so as to form an annular gap between the body and the casing;
- a central fluid passage extending along the body; and
- a plurality of scrapers provided in a stacked arrangement around said body, wherein each scraper comprises a plurality of chisel blades arranged to cut material protruding from the wall of the casing when the tool is moved downwardly relative to the casing and to leave any remaining material protruding from the wall of the casing when the tool is moved upwardly relative to the casing.

Preferably adjacent scrapers are arranged such that the chisel blades of adjacent scrapers are offset from each other. This ensures that an even scraping action is achieved around the circumference of the casing wall.

Preferably the scrapers are provided on one or more rings. Preferably the or each ring is rotatably mounted on the cylindrical body to allow the drill string to be rotated for drilling purposes without the rings and scrapers having to rotate relative to the casing. Preferably a plurality of rings are provided and each ring comprises means to prevent rotation relative to an adjacent ring.

Preferably each scraper comprises a disc resiliently mounted on the ring, most preferably spring mounted.

Preferably the profile of the blade is selected to provide an optimum cutting action when the chisel blade is moved downwardly relative to the casing wall. Preferably the upper edge of each chisel blade is tapered away from the casing wall. This allows the chisel blade to slide over any material protruding from the wall of the casing when the chisel blade is moved upwardly relative to the casing wall.

Preferably each chisel blade is orientated at an oblique angle relative to the longitudinal axis of the cylindrical body. Preferably the angle is 45°. This allows any material that is scraped from the wall of the casing by the chisel blade to move clear of the blade as the chisel blade is moved downwardly relative to the casing wall.

Preferably each chisel blade varies in height along the length of the blade. Preferably each chisel blade is least in height at substantially the leading portion of the blade when the blade is moved downwardly relative to the casing wall. Preferably each chisel blade is greatest in height at substantially the trailing portion of the blade when the blade is moved downwardly relative to the casing wall. This arrangement assists in allowing scraped material to move clear of the blade.

Preferably each disc has an outer surface that is arcuate. Preferably the curvature of the outer surface corresponds with the internal diameter of the casing.

According to a third aspect of the present invention there is provided a downhole tool comprising a string on which is provided at least one downhole collector tool according to a first aspect of the invention and at least one downhole scraper tool according to a second aspect of the invention.

Preferably the first fluid passage of the collector tool communicates with the central fluid passage of the scraper tool.

In one embodiment the downhole tool may comprise a first downhole collector tool and a first downhole scraper tool adapted to fit within a casing of a first diameter, and a second downhole collector tool and a second downhole scraper tool adapted to fit within a casing of a second diameter.

According to a fourth aspect of the present invention there is provided a method of cleaning a downhole well comprising the steps of:

- lowering into a well a string on which is provided a downhole collector tool and a downhole scraper tool,
- operating the scraper tool to clean the interior surface of the well,
- circulating mud through the string while the string remains in the well,
- circulating brine through the string while the string remains in the well, and
- removing the string from the well to collect debris in the brine.

Preferably the collector tool is a collector tool according to the first aspect of the present invention.

Preferably the scraper tool is a scraper tool according to the second aspect of the present invention.

An embodiment of the invention will now be described, by way of example only, with reference to the accompanying figures, where:

Figure 1:
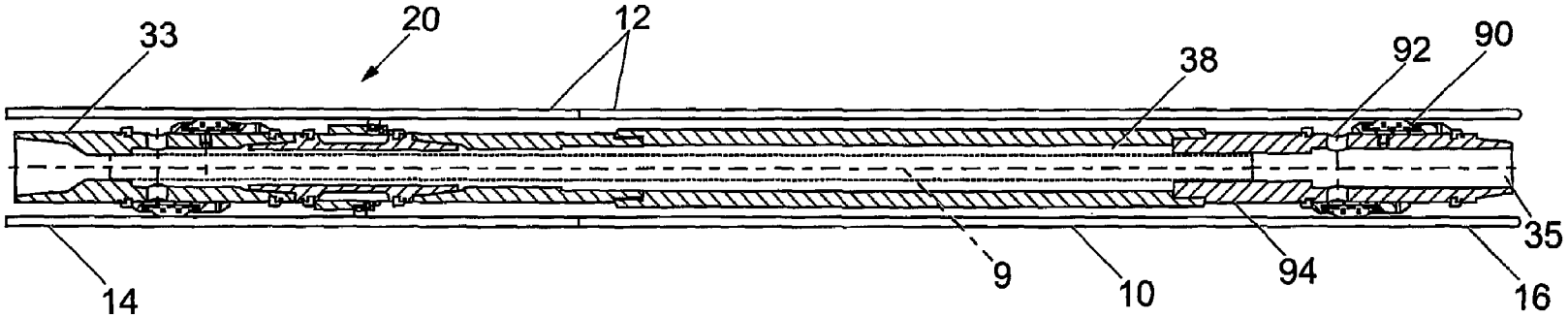
FIG. 1 is a longitudinal sectional view of a downhole collector tool within a casing according to the invention.

Referring to FIG. 1 there is shown a downhole collector tool 20 within a casing 10 which is typically connected to a drill string (not shown). It should be understood that, although the tool is described throughout as a downhole collector, it could also be described as a downhole filter or strainer.

The casing 10 is comprised of a number of longitudinal sections 12 which are connected together so that the casing 10 may be vertically inserted into a borehole (not shown). The casing 10 therefore has an upper end 14 and a lower end 16. The casing 10 is typically set in the borehole by cementing the space between the borehole and the casing. However, the cementing process may leave cement deposits within the casing 10 and at the bottom of the borehole. It is desirable to scrape away these cement deposits and then to collect and remove them from the borehole.

The diameter of the casing 10 may be increased one or more times along the length of the casing 10 with the lesser diameter casing sections 12 inserted first into the borehole. This allows smaller drill bits to be used for deeper drilling. A typical increase may be from a diameter of 178 mm (7 inches) to 244 mm (9.63 inches). The region where the diameter is increased is referred to as the casing lap. The drill string is made of a number of sections which are typically screwed together and inserted into the casing 10. The diameter of these sections may also increase along the length of the drill string to complement the increase in the casing 10. However, typically, the through-bore capacity of the sections will remain the same to maintain a constant fluid flow rate.

Casings are typically provided in various weights per linear meter by variation of the thickness of the casing section. The outer diameter of the casing is held constant and so the internal diameter may vary. The present invention accommodates such variation in the internal diameter.

Figure 2:
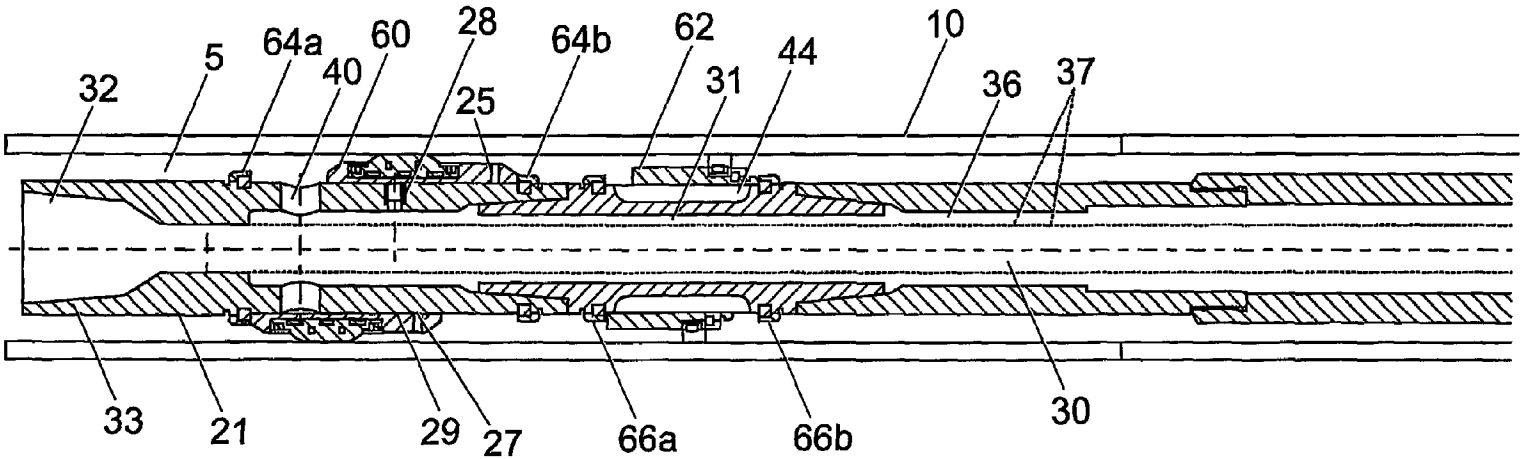
FIG. 2 is a longitudinal sectional view of a downhole collector tool according to the present invention.

FIG. 2 shows a portion of the downhole collector tool 20 of FIG. 1 in more detail. The downhole collector tool 20 is provided with conventional upper and lower threaded connectors 33, 35 for connection to adjacent lengths of drill pipe forming the drill string. The tool 20 has a cylindrical body 21 whose outside diameter is the same as that of the adjacent drill pipe. The outer diameter of the cylindrical body 21 is substantially smaller than the inner diameter of the casing 10 so that an annular gap 5 exists between the casing 10 and the body 21.

The cylindrical body 21 includes a central, first fluid passage 30 that has an upper inlet 32. This passage 30 connects to the passage provided in adjacent drill pipes, to enable drilling fluid to be passed down the length of the drill string. The passage 30 has a central portion 31 of increased diameter, within which is arranged a slotted screen 36. The body 21 also includes four secondary radial fluid passages 40 extending between the central portion 31 of the first fluid passage 30 and the annular gap 5. The secondary passages 40 are equally spaced around the perimeter of the collector tool 20 and allow fluid flow between the first fluid passage 30 and the annular gap 5. It can be appreciated that the secondary passages 40 do not require to be equally spaced.

The cylindrical body 21 also includes four bypass return fluid passages 44 in the form of longitudinally extending channels formed on the outer surface of the body 21. The bypass return passages 44 are equally spaced around the perimeter of the collector tool 20. It can be appreciated that the bypass return passages 44 do not require to be equally spaced.

The slotted screen 36 has longitudinal slots 37 which form a screen or filter between the second fluid passages 40 and the lower outlet 34 of the first fluid passage. Any large particles within the fluid passing from the second fluid passages 40 to the lower outlet 34 of the first fluid passage will be trapped in the sump 38 formed between the screen 36 and the wall of the wide portion 31 of the first fluid passage 30. The slots 37 of the screen are punched and have a diameter of around 1 mm. For smaller slot sizes, for example slots of one thousandth of 1 mm diameter, the slots may be laser cut. Other apparatus could be used to provide the screen 36 such as water jet cut slots or a wrapped screen. The screen 36 is located with one end at a distance of around 150 mm from the opening of the second fluid passage and extends parallel to the longitudinal axis 9. This ensures that the fluid is flowing in a longitudinal direction when the fluid flows past the screen 36 which minimises particles being forced through the slots 37 of the screen 36.

A first sliding sleeve member 60 is provided on the cylindrical body 21. The first sleeve 60 is free to slide in the longitudinal direction between first and second end stops 64*a*, 64*b*. When the first sleeve member 60 is in contact with the first end stop 64*a*, the sleeve is in a first position, as shown below the longitudinal axis 9 in FIG. 2. When the first sleeve member 60 is in contact with the second end stop 64*b*, the sleeve is in a second position, as shown above the longitudinal axis 9 in FIG. 2.

Figure 3A:
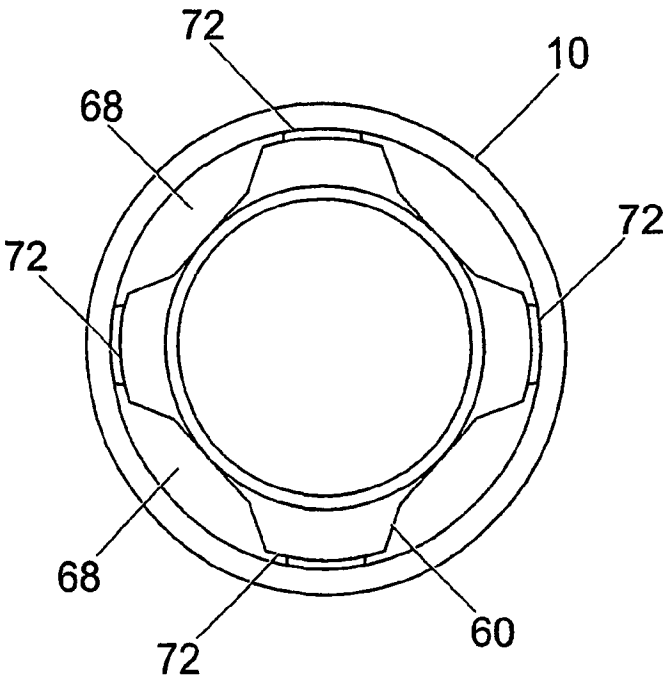
FIG. 3A is a transverse cross sectional view of the first sleeve of the downhole collector tool of FIG. 2.
Figure 3B:
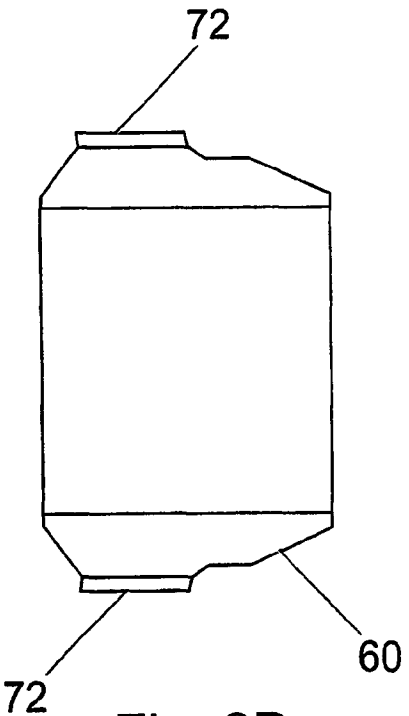
FIG. 3B is a longitudinal section of the first sleeve of the downhole collector tool of FIG. 2.

Referring to FIGS. 3A and 3B, it can be seen that the main body of the first sleeve 60 has a non-circular profile. This allows fluid to pass between the first sleeve 60 and the casing 10 through the formed spaces 68. The sleeve has four friction pads 72, each mounted on a disc spring (not shown), which ensures that the pad 72 remains in contact with the casing 10. It can be appreciated that other types of springs could be used, such as helical springs.

Figure 3C:
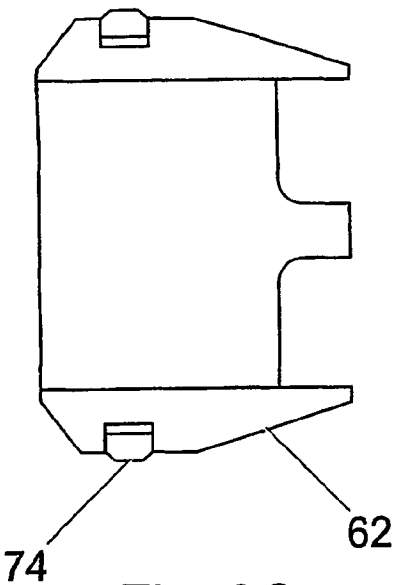
FIG. 3C is a longitudinal section of the second sleeve of the downhole collector tool of FIG. 2.

Referring to FIG. 3C. a second sliding sleeve member 62 is provided on the cylindrical body 21 below the first sleeve 60. The second sleeve 62 is free to slide in the longitudinal direction between first and second end stops 66*a*, 66*b*. When the second sleeve member 62 is in contact with the first end stop 66*a*, the sleeve is in a first position, as shown below the longitudinal axis 9 in FIG. 2. When the second sleeve member 62 is in contact with the second end stop 66*b*, the sleeve is in a second position, as shown above the longitudinal axis 9 in FIG. 2.

The second sleeve 62 has a circular seal 74 and prevents any fluid passing between the second sleeve 62 and the casing 10. The seal 74 is resiliently mounted so that the seal is urged into contact with the casing 10.

Both the first and second sleeves 60, 62 are rotatably mounted on the tool body 21, so that if the drill string is rotated, for example to operate a drill bit, then the pads 72 and seals 74 are not damaged by being forced to rotate with respect to the casing.

When the collector tool 20 is run into the hole, so that it moves downwards with respect to the casing, the pads 72 urge the first sleeve 60 into the first position by virtue of friction between the pads 72 and the casing 10, while the seal 74 urges the second sleeve 62 into the first position by virtue of friction between the seal 74 and the casing 10.

When fluid is pumped downwards in the first fluid passage 30 and returned via the annulus 5, the pressure of the fluid also urges the second sleeve 62 to a first position.

When the first sleeve member 60 is in the first position, the secondary passage 40 is closed by the sleeve 60 and so fluid cannot flow from the first fluid passage 30 to the annular gap 5. At the same time, when the second sleeve member 62 is in the first position, the cylindrical seal of the second sleeve 62 leaves a portion 46 of the bypass return fluid passage 44 open and fluid may pass between the cylindrical body 21 and the second sleeve 62. Therefore, as the collector tool 20 moves down, fluid is free to pass around the outside of the tool 20 without having to pass through the screen 36.

When the collector tool 20 is pulled out of the hole, so that it moves upwards with respect to the casing 10, the pads 72 urge the first sleeve 60 into the second position by virtue of friction between the pads 72 and the casing 10, while the seal 74 urges the second sleeve 62 into the second position by virtue of friction between the seal 74 and the casing 10.

When the first sleeve member 60 is in the second position, the secondary passage 40 is open and so fluid can flow from the annular gap 5 to the first fluid passage 30. At the same time, when the second sleeve member 62 is in the second position, the cylindrical seal of the second sleeve 62 covers the previously open portion 46 of the bypass return fluid passage 44 and fluid is prevented from passing between the cylindrical body 21 and the casing 10 by the second sleeve 62 and its seal 74. Therefore, as the collector tool 20 moves up, any fluid in the casing above the collector tool and outside the drill string is forced to pass into the secondary passages 40 and through the screen 36, before exiting at the lower outlet 34. In this way any debris in the casing is collected in the sump 38, where it may be removed when the collector tool 20 reaches the surface.

As shown in FIG. 1, a third sleeve 90 is provided near to the lower end of the collector tool 20. This sleeve 90 is similar in construction and operation to the first sleeve 60. During insertion of the drill string into the casing 10, the sleeve 90 is in a first position such that a port 92 provided in the cylinder body 94 is closed. The port 92 remains closed while fluid is being circulated through the drill string. When the drill string is being raised from the casing 10, the sleeve 90 moves to a second position and the port 92 is opened. Fluid may then flow into the annular gap 5 between the drill string and casing 10 via the port 92, rather than via the nozzles of the drill bit (not shown) that is fitted to the lower end of the drill string.

Figure 4:
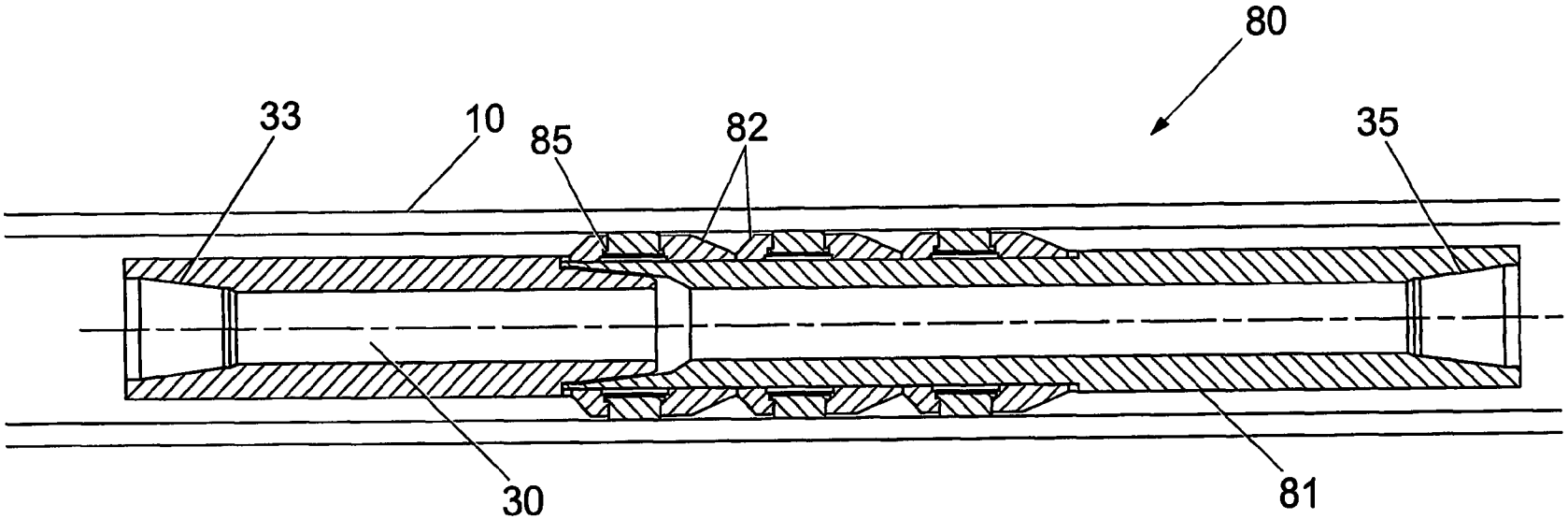
FIG. 4 is a longitudinal sectional view of a downhole scraper tool according to the present invention.

FIG. 4 shows a longitudinal cross sectional view of the downhole scraper tool 80. The downhole scraper tool 80 is provided with threaded connectors 33, 35 for connection to adjacent drill pipes or a collector tool 20. As before, the scraper tool 80 comprises a cylindrical body 81 whose external diameter is smaller than the internal diameter of the casing 10, and includes a central first fluid passage 30. Three scraper rings 82 are provided on the cylindrical body 81 with each ring having four scrapers in the form of discs 83 for removing material from the interior surface of the casing 10. Each disc is held within a mounting block 85 and is spring-mounted by means of a spring (not shown) to the scraper ring 82. The spring ensures that each disc 83 remains in contact with the casing 10 even when the scraper tool 80 is off centre in the casing 10.

The scraper rings 82 are rotatably mounted on the body 81 such that the tool body 81 may rotate but the scraper rings 82 do not rotate about the longitudinal axis 9. This avoids unnecessary wear to the blades 84. A locking ring (not shown) is provided to fix the position and orientation of the scraper rings 82.

Figure 5:
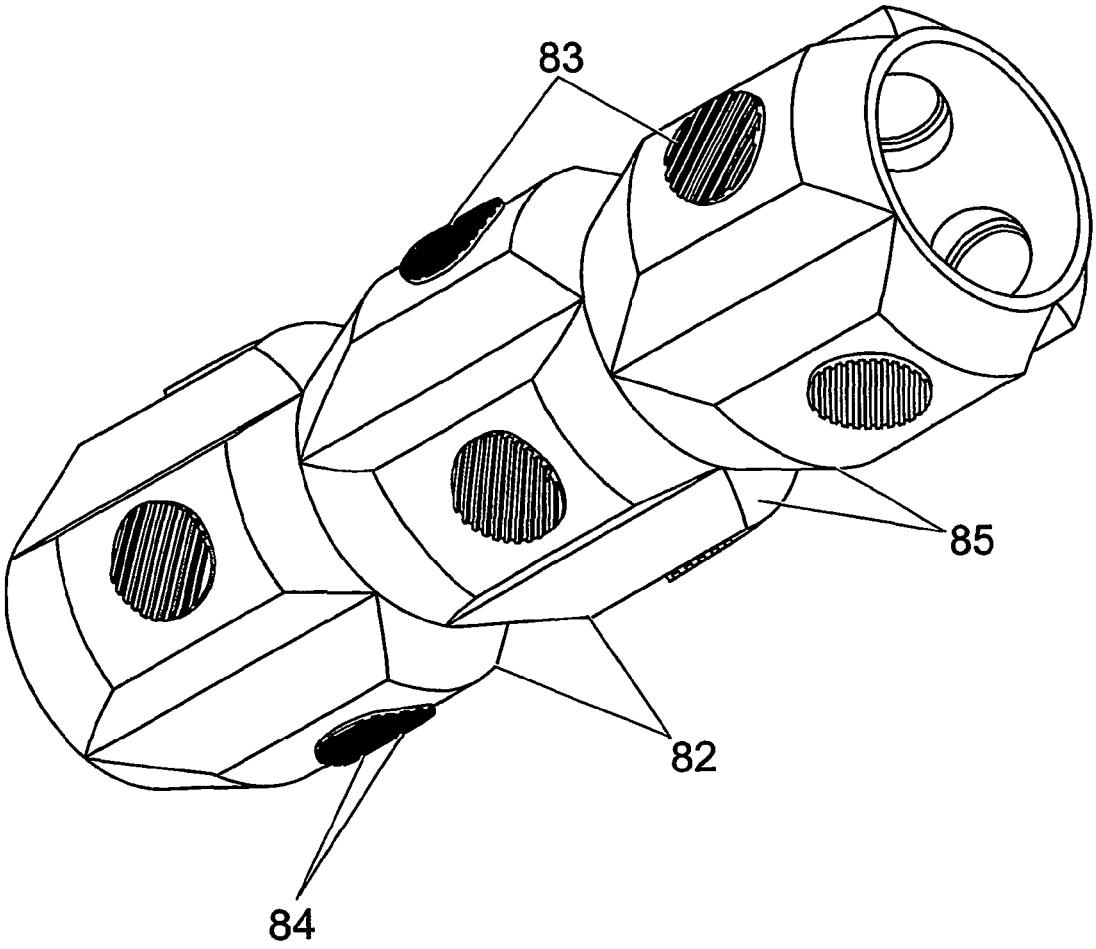
FIG. 5 is a perspective view of the scraper rings of the downhole scraper tool of FIG. 4.
Figure 6:
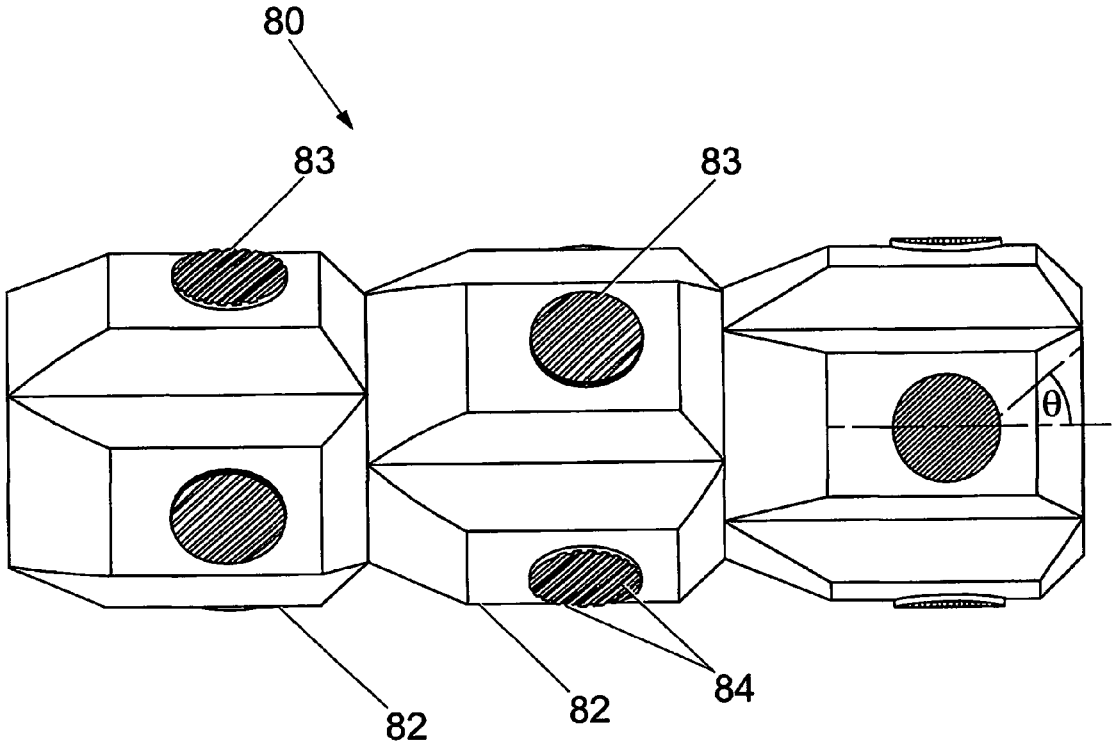
FIG. 6 is a longitudinal view of the scraper rings of the downhole scraper tool of FIG. 4.

Referring to FIGS. 5 and 6, the diameter of each disc 83 is selected such that it extends for approximately 30° around the circumference of the casing 10. Thus the twelve discs 83 provide full coverage of the internal diameter of the casing 10.

In fact, each disc 83 extends for 32° around the circumference of the casing 10 to provide a slight overlap with the adjacent disc. The discs 83 are arranged such that each successive disc 83 is offset from the closest disc 83 of the adjacent ring 82. This arrangement minimises the stresses on any particular disc 83.

Each disc 83 has a number of parallel blades 84. Each blade 84 is orientated at an angle ø of 45° relative to the longitudinal axis of the cylindrical body 21. This allows any material that is scraped from the wall of the casing by the chisel blade to move clear of the blade as the chisel blade is moved downwardly relative to the casing 10. The discs 83 are therefore self-cleaning in operation. It has been found that if angle ø is between 25° and 65° and effective degree of self cleaning is obtainable.

Each chisel blade 84 also varies in height along the length of the blade 84. The height is greatest at the leading portion of the blade 84, and least at the trailing portion of the blade 84, when the blade 84 is moved downwards relative to the casing wall 10. This arrangement assists in allowing scraped material to move clear of the blade.

Each disc 83 has a curved outer surface with the curvature designed to correspond with the internal diameter of the casing 10.

Each blade 84 is profiled such that it provides a cutting action when the tool 80 is urged downwards but provides no cutting action when the tool 80 is urged upwards.

The method of operation of a tool string incorporating two collector tools 20 and two scraper tools 80 will now be described.

A drill string is assembled to include alternating sections of the scraper tool 80 and the collecting tool 20. The elements of the drill string are connected and lowered into the casing 10. The downward urging of the drill string will provide a scraping action to the interior surface of the casing 10. It will also cause the sleeves 60, 62 to move, by friction action of the pads 72 and seals 74 on the casing 10, to the first position.

While the drill string is in operation, mud under pressure is supplied at the upper inlet 32. With the first sleeve 60 in the first position, the mud is prevented from flowing from the first fluid passage 30 to the annular gap 5 via the second fluid passage 40. Therefore, the mud travels through each section of the drill string to its lower end 16 which is positioned at the bottom of the bore hole. The mud will flow out of the first fluid passage 30 and then travel up the annular gap 5, carrying any material that has collected at the bore hole bottom.

As the mud flows upwards, it also gathers loose material or debris from the wall of the casing 10. When the mud reaches the second sleeve 62 of the collector tool 20, it may pass between the second sleeve 62, as the bypass return fluid passage 44 is open, and between the first sleeve 60 and the casing 10 due to the profile of the main body of the first sleeve 60*a*. Fluid pressure from the mud coming up the annulus 5 also helps to maintain the sleeves 60, 62 in their first positions. The mud is therefore free to exit to the surface at the upper end 14 of the drill string.

Mud is typically used to remove particles due to its higher viscosity. Other fluids, such as brine, may also be used. The present invention allows the switch from one fluid to another without the removal or modification of the drill string.

Once the cleaning process is complete (this can be judged by the quality of the brine that is returned from the well and collected at the upper inlet 32), the pressurised supply of fluid to the first fluid passage is removed and the drill string is withdrawn. Urging the drill string upwards causes both sleeves to move to the second position, under the action of friction between the casing 10 and the drag blocks 72 and seals 74.

With the drill string moving upwards, and the bypass return flow passage closed, fluid in the annulus 5 above the collector tool 20 is forced through the secondary passages 40 and into the first fluid passage 30 via the screen. The fluid will then flow down the first fluid passage into the well through the lower inlet 34. Any remaining particles in the fluid are trapped by the screen 36 and remain in the sump 38.

When the drill string is being raised from the casing 10, the third sleeve 90 moves to a second position and the port 92 is opened. Fluid may then flow into the annular gap 5 between the drill string and casing 10 via the port 92, rather than via the nozzles of the drill bit.

It has been found that the first sleeve 60 may not always move to the first position when the drill string is lowered into the casing 10. The sleeve 60 is being moved against gravity and may be off centre when the drill string is lowered. Also, vibration during drilling may cause the sleeve 60 to move from the first to the second position during operation. This is not a problem for the second sleeve 62 because of the greater contact with the casing 10 provided by the seal 74, and because the pressure from the fluid maintains the second sleeve 62 in the first position during pumping.

To alleviate these problems, the pads 72 have a large surface area for contact with the casing 10. Also, disc springs are used to provide a larger biasing force than can be provided by conventional compression springs. The collector tool 20 includes inhibiting means to inhibit movement of the first sleeve 60 to the second position. The inhibiting force is predetermined such that it is insufficient to prevent movement to the second position when the drill string is being raised from the casing 10.

The inhibiting means may in the form of a ball or roller bearing (not shown) positioned within a recess 25 provided on the first sleeve 60. The bearing is mounted on a spring which biases the bearing towards the cylindrical body 21. When the first sleeve 60 is in the first position, the bearing extends into a shallow groove 27 that extends around the outer diameter of the cylindrical body 21. The first sleeve 60 must overcome the biasing force to move to the second position. It can be appreciated that the recess may be provided on the cylindrical body 21 and the bearing is urged towards the first sleeve 60.

The inhibiting means also comprises a detent 28 provided at the cylindrical body 21 and adapted to engage with a socket 29 provided on the first sleeve 60 when the first sleeve 60 is in the first position. The detent 28 is provided in an aperture in fluid communication with the secondary fluid passage 40. The detent 28 is then urged towards the socket 29 by fluid flowing in the passage 40. It can be appreciated that the detent 28 may be provided in a recess provided in the cylindrical body 21 and spring urged towards the socket 29.

The third sleeve 90 is also provided with inhibiting means (ball bearing within a recess and detent within an aperture) to inhibit movement to the second position.

The apparatus of the invention allows simple combined scraping and collecting with minimal surface intervention.

Other aspects, objects and advantages of this invention can be obtained from a study of the drawings, the disclosure and the appended claims. For example, the first and second sleeve may be mechanically linked so that their operation is synchronised. The sleeves 60, 62 may be moved in either direction between the first and second positions by using means other than friction between the sleeves and the casing 10. The sleeves may be hydraulically or electromechanically operated, or adapted to be operated by pressure cycles of the fluid or by dropping a ball down the first fluid passage 30.

The invention claimed is:

1. A downhole collector tool for use within a casing having a casing diameter and an interior surface, comprising:

a cylindrical body having an external diameter smaller than the casing diameter so as to form an annular gap between the cylindrical body and the casing;

a first downhole fluid passage provided in the cylindrical body and having an upper inlet and a lower outlet;

at least one secondary fluid passage extending between the first downhole fluid passage and the annular gap;

a filter means arranged between said at least one secondary fluid passage and said outlet; and a first sleeve member provided on the cylindrical body and adapted to move between a first position in which said at least one secondary fluid passage is closed and a second position in which said at least one secondary fluid passage is open, wherein the first sleeve member is provided in the annular gap.

2. A downhole collector tool according to claim 1, wherein the first sleeve member is provided with friction means adapted to engage with the interior surface of the casing.

3. A downhole collector tool according to claim 2, wherein the friction means is urged towards the casing by biasing means.

4. A downhole collector tool according to claim 3, wherein the biasing means comprises at least one disc spring.

5. A downhole collector tool according to claim 1, wherein the first sleeve member is arranged such that movement of the tool downwardly relative to the casing urges the first sleeve member to the first position.

6. A downhole collector tool according to claim 1, wherein the first sleeve member is arranged such that movement of the tool upwardly relative to the casing urges the first sleeve member to the second position.

7. A downhole collector tool according to claim 1, comprising a plurality of secondary fluid passages arranged substantially radially about the a longitudinal axis of the cylindrical body.

8. A downhole collector tool according to claim 1, wherein the first sleeve member is provided with cut-out portions adapted to permit fluid flow in the annular gap past the first sleeve member.

9. A downhole collector tool according to claim 1, wherein the filter means is a cylindrical slotted screen extending along the first downhole fluid passage.

10. A downhole collector tool according to claim 1, further comprising at least one bypass return fluid passage adapted to permit upward fluid flow through the annular gap when said at least one secondary fluid passage is closed.

11. A downhole collector tool according to claim 10, wherein the bypass return fluid passage is formed as a channel in the exterior surface of the cylindrical body.

12. A downhole collector tool according to claim 10, further comprising a bypass valve for opening and closing said bypass return fluid passage.

13. A downhole collector tool according to claim 12, wherein the bypass valve comprises a second sleeve member provided on the body.

14. A downhole collector tool according to claim 13, wherein at least one lower secondary fluid passage is provided proximal to the lower outlet and a third sleeve member is provided on the cylindrical body, the third sleeve member being adapted to move between a first position in which said at least one lower secondary fluid passage is closed and a second position in which said at least one lower secondary fluid passage is open.

15. A downhole collector tool according to claim 12, wherein the bypass valve is provided with friction means adapted to engage with the interior surface of the casing.

16. A downhole collector tool according to claim 15, wherein the friction means comprises a seal extending around the second sleeve member, the seal being adapted to prevent fluid flow between the second sleeve member and the casing.

17. A downhole collector tool according to claim 15, wherein the friction means is arranged such that movement of the tool upwardly relative to the casing urges the second sleeve member to a first position in which the bypass return flow passage is closed.

18. A downhole collector tool according to claim 12, wherein the bypass valve is arranged such that movement of the tool downwardly relative to the casing urges the bypass valve to a second position in which the bypass return flow passage is open.

19. A downhole collector tool according to claim 1, wherein the collector tool includes inhibiting means adapted to inhibit movement of the first sleeve member from the first position towards the second position.

20. A downhole collector tool according to claim 19, wherein the inhibiting means comprises a ball or roller bearing positioned within a recess provided on the cylindrical body, the bearing being spring urged towards the casing such that the first sleeve member must overcome the urging force to move to the second position.

21. A downhole collector tool according to claim 19, wherein the inhibiting means comprises a detent provided at the cylindrical body, the detent being adapted to engage with a socket provided on the first sleeve member when the first sleeve member is in the first position.

22. A downhole collector tool according to claim 21, wherein the detent is provided in a recess provided in the cylindrical body and spring urged towards the socket.

23. A downhole collector tool according to claim 21, wherein the detent is provided in an aperture in fluid communication with at least one of the first downhole fluid passage and the secondary fluid passage, the detent being urged towards the socket by fluid flowing in the or each passage.

24. A downhole scraper tool for use within a casing having a casing diameter and an interior surface, comprising:

a cylindrical body having an external diameter smaller than the casing diameter so as to form an annular gap between the body and the casing;

a central fluid passage extending along the cylindrical body; and a plurality of scrapers provided in a stacked arrangement around said cylindrical body, wherein each scraper comprises a plurality of chisel blades arranged to cut material protruding from the wall of the casing when the tool is moved downwardly relative to the casing and to leave material protruding from the wall of the casing when the tool is moved upwardly relative to the casing.

25. A downhole scraper tool according to claim 24, wherein each scraper comprises a disc having a plurality of blades and adjacent discs are arranged such that the chisel blades of adjacent discs are offset from each other.

26. A downhole scraper tool according to claim 25, wherein the discs are provided on at least one ring rotatably mounted on the cylindrical body.

27. A downhole scraper tool according to claim 26, wherein the a plurality of rings are stacked adjacent to each other and are rotatably fixed relative to each other.

28. A downhole scraper tool according to claim 26, wherein each disc is resiliently mounted on the at least one ring.

29. A downhole scraper tool according to claim 26, wherein each blade has an upper edge and a lower edge, the upper edge of each blade subtending an angle at the casing wall which is smaller than the angle subtended by the lower edge.

30. A downhole scraper tool according to claim 25, wherein each blade is orientated at an oblique angle relative to the a longitudinal axis of the cylindrical body.

31. A downhole scraper tool according to claim 25, wherein each disc has an outer surface that is arcuate, the curvature of the outer surface corresponding with the casing diameter.

32. A downhole scraper tool according to claim 31, wherein each disc is of sufficiently small diameter such that variation in the internal diameter of the casing does not cause a substantial mismatch between the outer surface of the disc and the casing diameter.

33. A downhole scraper tool according to claim 25, wherein each chisel blade varies in height along the length of the blade.

34. A downhole scraper tool according to claim 33, wherein each chisel blade is least in height at substantially the leading portion of the blade when the blade is moved downwardly relative to the casing wall, and wherein each chisel blade is greatest in height at substantially the trailing portion of the blade when the blade is moved downwardly relative to the casing wall.

* * * * *